US011611168B2

(12) United States Patent
Ruffini et al.

(10) Patent No.: US 11,611,168 B2
(45) Date of Patent: Mar. 21, 2023

(54) CABLE CONNECTOR WITH CONTACT HOLDER LATCHING TO THE OUTER SHELL

(71) Applicant: TE Connectivity Services GmbH, Schaffhausen (CH)

(72) Inventors: Nicholas Paul Ruffini, Lancaster, PA (US); Lynn Robert Sipe, Mifflintown, PA (US)

(73) Assignee: TE CONNECTIVITY SOLUTIONS GmbH, Schaffhausen (CH)

( * ) Notice: Subject to any disclaimer, the term of this patent is extended or adjusted under 35 U.S.C. 154(b) by 17 days.

(21) Appl. No.: 17/384,850

(22) Filed: Jul. 26, 2021

(65) Prior Publication Data

US 2023/0025319 A1 Jan. 26, 2023

(51) Int. Cl.

| | |
|---|---|
| ***H01R 13/426*** | (2006.01) |
| ***H01R 13/405*** | (2006.01) |
| ***H01R 24/86*** | (2011.01) |
| ***H01R 13/04*** | (2006.01) |
| ***H01R 13/502*** | (2006.01) |
| ***H01R 13/62*** | (2006.01) |
| ***H01R 13/6593*** | (2011.01) |

(Continued)

(52) U.S. Cl.

CPC ..... *H01R 13/426* (2013.01); *H01R 13/04* (2013.01); *H01R 13/405* (2013.01); *H01R 13/502* (2013.01); *H01R 13/62* (2013.01); *H01R 13/6585* (2013.01); *H01R 13/6586* (2013.01); *H01R 13/6593* (2013.01); *H01R 24/86* (2013.01)

(58) Field of Classification Search

CPC .... H01R 13/426; H01R 13/04; H01R 13/405; H01R 13/502; H01R 13/62; H01R 13/6585; H01R 13/6586; H01R 13/6593; H01R 24/86

See application file for complete search history.

(56) References Cited

U.S. PATENT DOCUMENTS 6,669,502 B1 * 12/2003 Bernhart ..... H01R 33/765 439/460

10,454,197 B1 10/2019 Ruffini et al.

(Continued)

FOREIGN PATENT DOCUMENTS

DE 202015103479 U1 * 9/2015 ..... H01R 13/6586

OTHER PUBLICATIONS

Machine Translation DE 202015103479 (Aug. 3, 2015) (Year: 2022).*

*Primary Examiner* — Travis S Chambers

(57) ABSTRACT

A cable connector includes an outer shell having a bore extending between a mating end and a cable end. The outer shell has latch pockets. The cable connector includes a shield received in the outer shell that divides the bore into chambers. The cable connector includes contact holders received in corresponding chambers. Each contact holder includes at least one contact channel and a deflectable latch having a latching head at a distal end of the latch configured to be received in the corresponding latch pocket of the outer shell to axially secure the contact holder in the outer shell. The latch has an interference bump at an inner end of the latch configured to engage the shield to press the latching head of the latch outward. The cable connector includes contacts received in corresponding contact channels of the corresponding contact holders.

20 Claims, 8 Drawing Sheets

(51) Int. Cl.
*H01R 13/6585* (2011.01)
*H01R 13/6586* (2011.01)

(56) References Cited

U.S. PATENT DOCUMENTS

| | | | | |
|---|---|---|---|---|
| 11,095,076 | B2 * | 8/2021 | Ruffini | H01R 43/048 |
| 2014/0302724 | A1 * | 10/2014 | Ono | H01R 13/502<br>439/751 |
| 2015/0295365 | A1 * | 10/2015 | Post | H01R 13/40<br>439/607.03 |

* cited by examiner

CABLE CONNECTOR WITH CONTACT HOLDER LATCHING TO THE OUTER SHELL

BACKGROUND OF THE INVENTION

The subject matter herein relates generally to cable connectors.

Cable connectors are used in many applications, such as in military and aeronautical applications. For example, the cable connectors may include differential pair contacts terminated to ends of twisted wire pairs. Some known cable connectors are known as quadrax connectors having four differential pairs of contacts arranged in different quadrants of the cable connector. The cable connector includes an outer shell providing shielding for the contact pairs. However, known cable connectors are not without disadvantages. For instance, assembly of the cable connector is difficult. Retention of the contacts in the outer shell is difficult. For example, a retainer is used to hold the contacts within the outer shell of the cable connector. Positioning and securing the retainer in the outer shell is difficult. Some known retainers use a latch. However, the latch may be damaged during assembly as the latch is pressed against the outer shell.

A need remains for a cable connector that may be manufactured and assembled in a cost effective and reliable manner.

BRIEF DESCRIPTION OF THE INVENTION

In one embodiment, a cable connector is provided and includes an outer shell having a bore. The outer shell extends between a mating end and a cable end. The outer shell has latch pockets. The cable connector includes a shield received in the outer shell. The shield divides the bore into chambers. The shield and the outer shell provides shielding for the chambers. The cable connector includes contact holders received in corresponding chambers. Each contact holder includes at least one contact channel. Each contact holder includes a deflectable latch. The latch has a latching head at a distal end of the latch configured to be received in the corresponding latch pocket of the outer shell to axially secure the contact holder in the outer shell. The latch has an interference bump at an inner end of the latch configured to engage the shield to press the latching head of the latch outward. The cable connector includes contacts received in corresponding contact channels of the corresponding contact holders. The contacts held in the bore of the outer shell by the contact holders. Each contact extends between a mating end and a terminating end. The terminating end configured to be terminated to a wire of a cable.

In another embodiment, a cable connector is provided and includes an outer shell having a bore. The outer shell extends between a mating end at a front of the outer shell and a cable end at a rear of the outer shell. The outer shell has a forward portion and a rearward portion rearward of the forward portion. The outer shell has latch pockets. The cable connector includes a shield received in the outer shell. The shield divides the bore into chambers. The chambers has a first width at the forward portion and a second width at the rearward portion. The second width is wider than the first width. The shield and the outer shell provides shielding for the chambers. The cable connector includes contact holders received in corresponding chambers. Each contact holder includes at least one contact channel. Each contact holder includes a deflectable latch. The latch has a latching head at a distal end of the latch configured to be received in the corresponding latch pocket of the outer shell to axially secure the contact holder in the outer shell. The latch has an interference bump at an inner end of the latch. The inner end engaging the shield to press the latching head of the latch outward. The latching head is pressed further outward in the forward portion compared to the rearward portion. The cable connector includes contacts received in corresponding contact channels of the corresponding contact holders. The contacts held in the bore of the outer shell by the contact holders. Each contact extends between a mating end and a terminating end. The terminating end configured to be terminated to a wire of a cable.

In a further embodiment, a cable connector is provided and includes an outer shell having a bore. The outer shell is generally cylindrical. The outer shell extends between a mating end and a cable end. The outer shell has latch pockets. The cable connector includes a shield received in the outer shell. The shield has a first shield panel and a second shield panel perpendicular to the first shield panel divides the bore into four chambers. The shield and the outer shell provides shielding for the chambers. The cable connector includes contact holders received in corresponding chambers. Each contact holder includes a first side wall and a second side wall meeting at an inner edge. Each contact holder includes an outer wall between the first side wall and the second side wall. Each contact holder includes a pair of contact channels. Each contact holder includes a deflectable latch. The latch includes a latch arm extends between a fixed end and a free end. The latch arm extends along the inner edge. The latch has a latching head at the free end of the latch configured to be received in the corresponding latch pocket of the outer shell to axially secure the contact holder in the outer shell. The latch has an interference bump at an inner end of the latch configured to engage the shield to press the latching head of the latch outward. The cable connector includes contacts received in corresponding contact channels of the corresponding contact holders. The contacts arranged in pairs. The contacts held in the bore of the outer shell by the contact holders. Each contact extends between a mating end and a terminating end. The terminating end configured to be terminated to a wire of a cable.

DETAILED DESCRIPTION OF THE INVENTION

Figure 1:
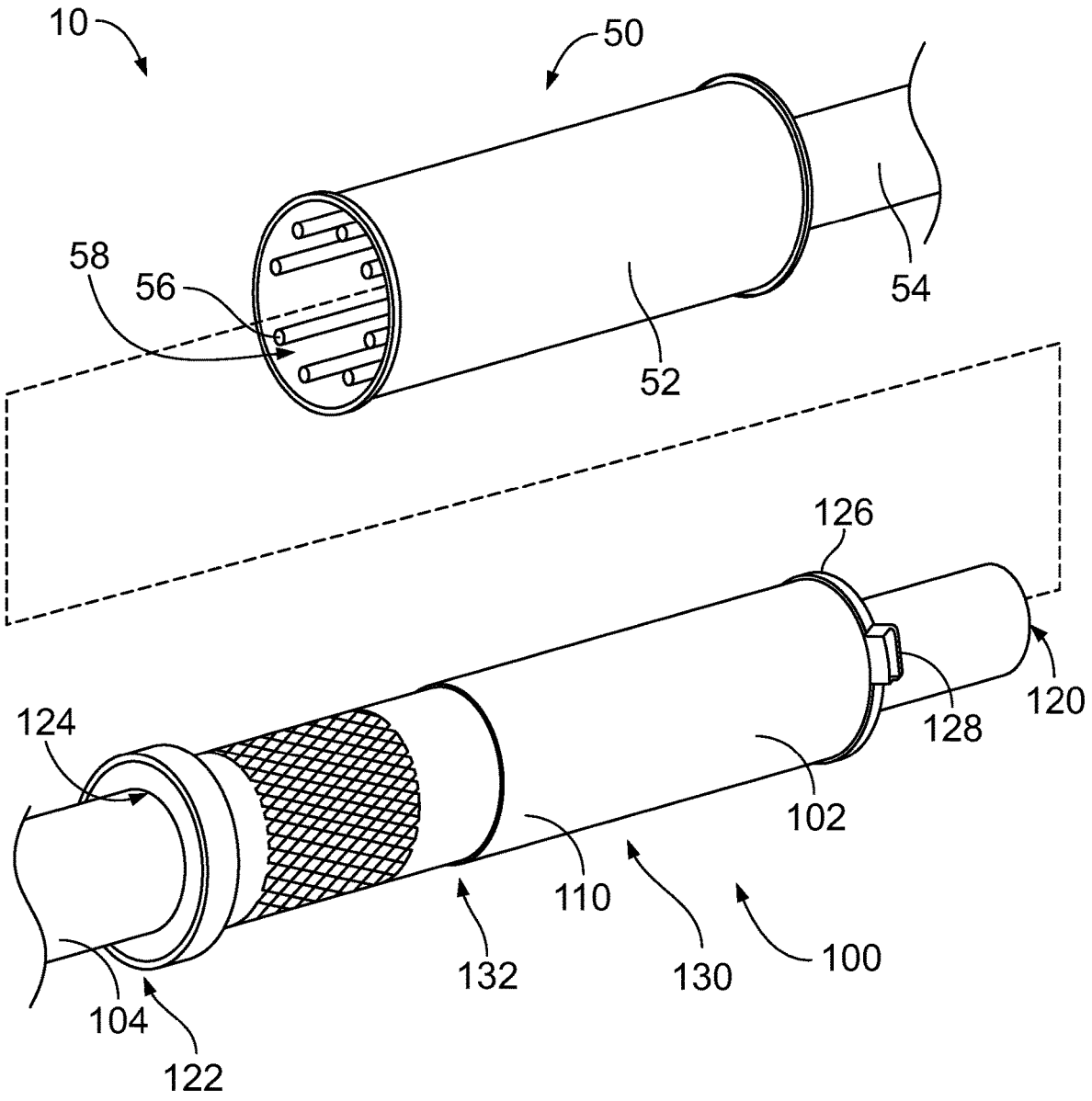
FIG. 1 is a front perspective view of a communication system in accordance with an exemplary embodiment showing an electrical connector configured to be mated with a mating connector.
Figure 2:
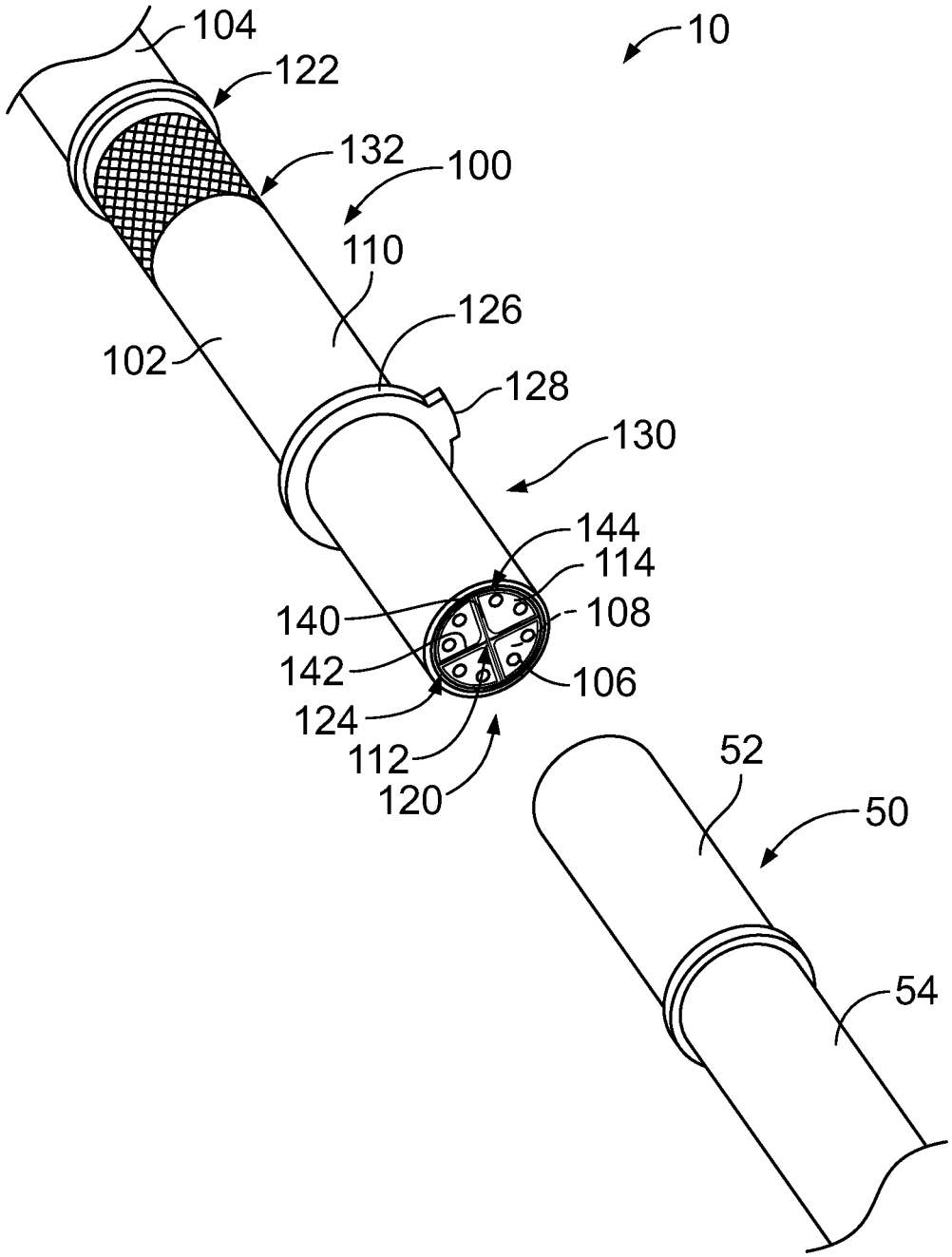
FIG. 2 is a rear perspective view of a communication system in accordance with an exemplary embodiment showing the electrical connector configured to be mated with the mating connector.

FIG. 1 is a front perspective view of a communication system 10 in accordance with an exemplary embodiment showing an electrical connector 100 configured to be mated with a mating connector 50. FIG. 2 is a rear perspective view of a communication system 10 in accordance with an exemplary embodiment showing the electrical connector 100 configured to be mated with the mating connector 50. In the illustrated embodiment, the electrical connector 100 is a cable connector and may be referred to hereinafter as a cable connector 100. The electrical connector 100 includes a connector 102 provided at an end of a cable 104. In the illustrated embodiment, the mating connector 50 is a cable connector and may be referred to hereinafter as a cable connector 50. The mating connector 50 includes a connector portion 52 provided at an end of a cable 54. However, in alternative embodiments, the mating connector 50 may be another type of connector, such as a header connector or board connector mounted to a circuit board.

In an exemplary embodiment, the connector 102 includes a plurality of contacts 106 arranged in contact pairs 108. The mating connector portion 52 similarly includes a plurality of mating contacts 56 arranged in contact pairs 58 configured to be mated with the corresponding contacts 106 of the cable connector 100. In the illustrated embodiment, the mating contacts 56 are socket contacts and the contacts 106 are pin contacts; however, other types of contacts may be used in alternative embodiments. In an exemplary embodiment, the connectors 102, 50 are quadrax connectors each including four contact pairs 108, 58, respectively. The contact pairs 108, 58 are arranged in quadrants. Other types of connectors may be used in alternative embodiments having greater or fewer contact pairs 108, 58.

The description below references the first cable connector 100 and the components of the cable connector 100; however, the second cable connector 50 may include similar components and be manufactured in a similar manner as described below with reference to the first cable connector 100.

The cable connector 100 includes an outer shell 110, a shield 112 (shown in FIG. 2) received in the outer shell 110, and one or more contact holders 114 received in the outer shell 110. In the illustrated embodiment, the cable connector 100 includes four contact holders 114 arranged in the four quadrants of the outer shell 110. The shield 112 separates the contact holders 114 from each other and provides electrical shielding between the contact holders 114. The contact holders 114 hold the contacts 106. For example, each contact holder 114 may hold one of the contact pairs 108. In an exemplary embodiment, the contact holders 114 are latchably coupled to the outer shell 110 to retain and position the contacts 106 in the outer shell 110 for mating with the mating contacts 56.

The outer shell 110 extends between a mating end 120 and a cable end 122. The cable 104 extends from the cable end 122. The mating end 120 is configured to be coupled to the mating connector 50. The outer shell 110 is manufactured from a conductive material, such as a metal material. The outer shell 110 includes a bore 124 extending axially through the outer shell 110 between the mating end 120 and the cable end 122. In an exemplary embodiment, the outer shell 110 is generally cylindrical. The outer shell 110 may have different inner and/or outer diameters along the central, longitudinal axis.

In an exemplary embodiment, the outer shell 110 includes a flange 126, which may be approximately centered along the outer shell 110. The flange 126 may engage the mating connector 50 during mating to stop mating. The outer shell 110 includes a keying feature 128 for keyed mating with the mating connector 50 or positioning the cable connector 100 relative to another component. Optionally, the keying feature 128 may be located at the flange 126.

In an exemplary embodiment, the outer shell 110 includes a forward portion 130 and a rearward portion 132 rearward of the forward portion 130. The forward portion 130 may be located at the mating end 120. The rearward portion 132 may be located at the cable end 122. The outer shell 110 may include other portions between or on either side of the portions 130, 132. The outer shell 110 may have different diameters (for example, internal diameters and/or external diameters) along the forward portion 130 and the rearward portion 132. In an exemplary embodiment, the contact holders 114 and the shield 112 are rear loaded into the bore 124 through the cable end 122.

In an exemplary embodiment, the shield 112 is a cross-shield being cross-shaped (for example, X-shaped). The shield 112 includes a first shield panel 140 and a second shield panel 142 perpendicular to the first shield panel 140. The first shield panel 140 and the second shield panel 142 divide the bore 124 into chambers 144, such as four chambers 144 arranged in quadrants. Each chamber 144 receives one of the contact holders 114. In an exemplary embodiment, each chamber 144 receives a pair of the contacts 106. The shield panels 142 are conductive, such as being metal plates. The shield panels 142 may be electrically connected to the outer shell 110. The shield 112 and the outer shell 110 provide shielding for the chambers 144.

Figure 3:
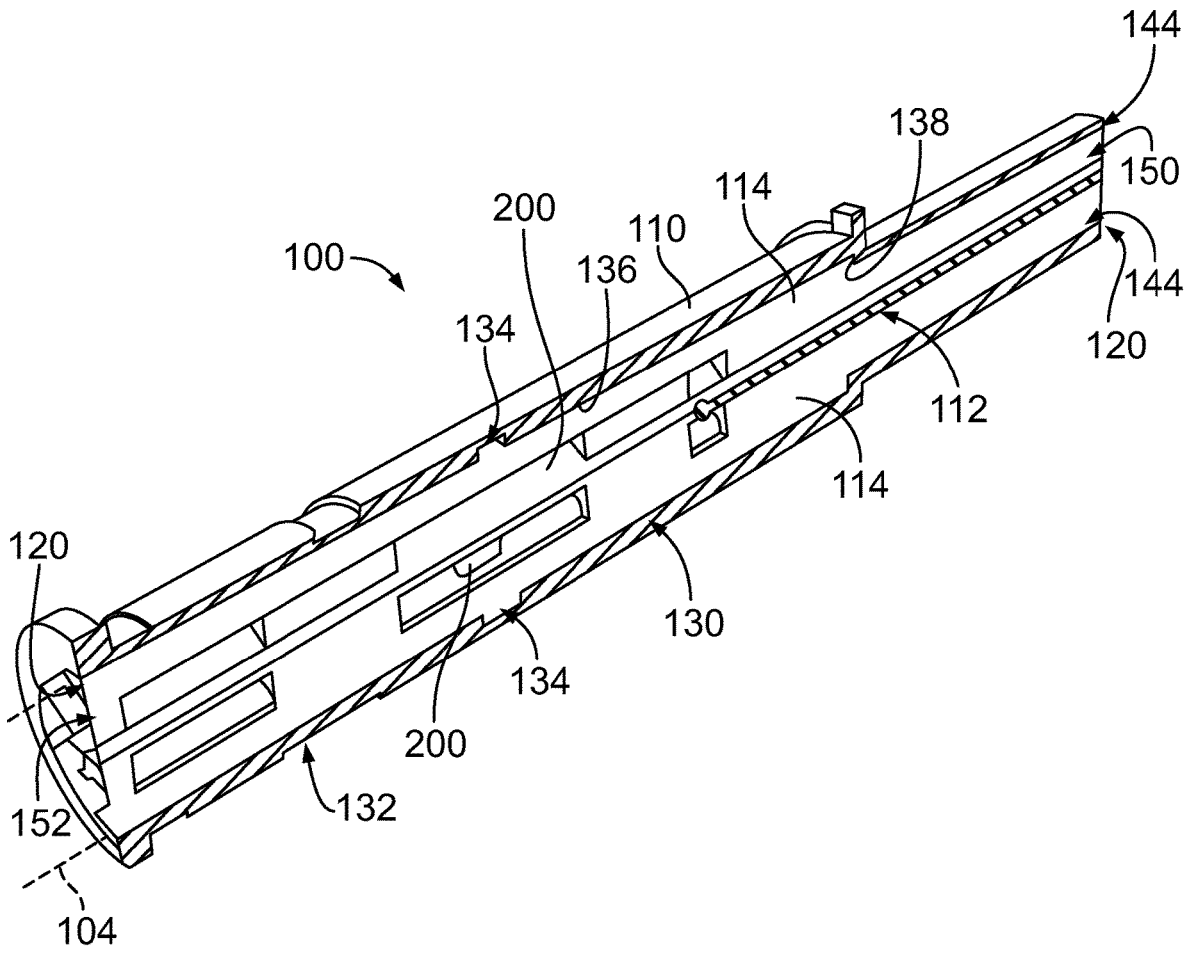
FIG. 3 is a cross-sectional view of the cable connector in accordance with an exemplary embodiment.

FIG. 3 is a cross-sectional view of the cable connector 100 in accordance with an exemplary embodiment. The cable connector 100 includes the shield 112 and the contact holder 114 in the bore 124 of the outer shell 110. The shield 112 separates the contact holders from each other. In an exemplary embodiment, the contact holders 114 are held in the bore 124 using latches, such as latches integral with the contact holder 114.

Each contact holder 114 extends between a mating end 150 and a cable end 152 opposite the mating end 150. The contacts 106 (now shown) are generally held at the mating end 150. Wires (not shown) of the cable 104 extend from the cable end 152. In an exemplary embodiment, each contact holder 114 includes a latch 200 used to secure the contact holder 114 in the outer shell 110. The latch 200 is deflectable and configured to be latchably coupled to the outer shell 110 during assembly. In an exemplary embodiment, the outer shell 110 includes latch pockets 134 that receive the latches 200. The latch pockets 134 are located along an interior surface 136 of the outer shell 110. The latch pockets 134 may be generally centered along the outer shell 110, such as in a middle half of the outer shell 110. The latch pockets 134 may be formed by a circumferential groove in the outer shell 110 or, alternatively, may be individual pockets.

In an exemplary embodiment, the forward portion 130 is located forward of the latch pockets 134 and the rearward portion 132 is located rearward of the latch pockets 134. In an exemplary embodiment, the forward portion 130 has a first diameter and the rearward portion 132 has a second diameter different than the first diameter. For example, the second diameter may be greater than the first diameter. The contact holders 114 are rear loaded into the bore 124 and the larger diameter along the rearward portion 132 makes assembly easier, such as by reducing drag of the latch 200 along the interior surface 136, which may reduce damage to the latch 200 during assembly.

In an exemplary embodiment, the outer shell 110 includes a shoulder 138 near the mating end 120. The shoulder 138 may be located along the forward portion 130. The shoulder 138 is used for locating the contact holders 114 in the chambers 144. The shoulder 138 blocks forward movement of the contact holders 114 in the bore 124. The latches 200, when engaged with the outer shell 110 in the latch pockets 134, block rearward movement of the contact holders 114 in the bore 124.

Figure 4:
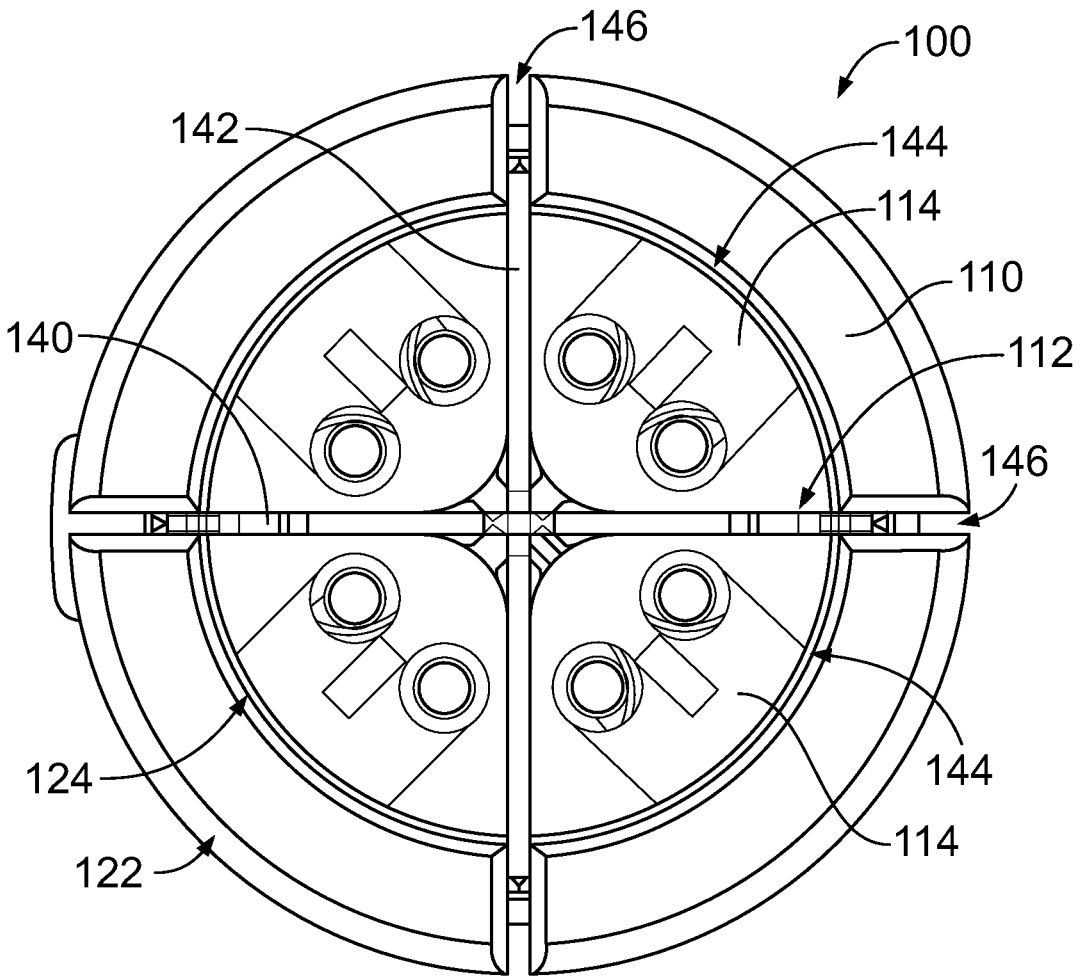
FIG. 4 is an end view of the cable connector in accordance with an exemplary embodiment.

FIG. 4 is an end view of the cable connector 100 in accordance with an exemplary embodiment. The cable connector 100 includes the shield 112 received in the bore 124 of the outer shell 110. FIG. 4 illustrates the first and second shield panels 140, 142 arranged in a cross-configuration oriented perpendicular to each other and dividing the bore 124 into four chambers 144. In the illustrated embodiment, the shield panels 140, 142 are received in slots 146 at the cable end 122. The contact holders 114 are rear loaded into the outer shell 110 through the cable end 122.

Figure 5:
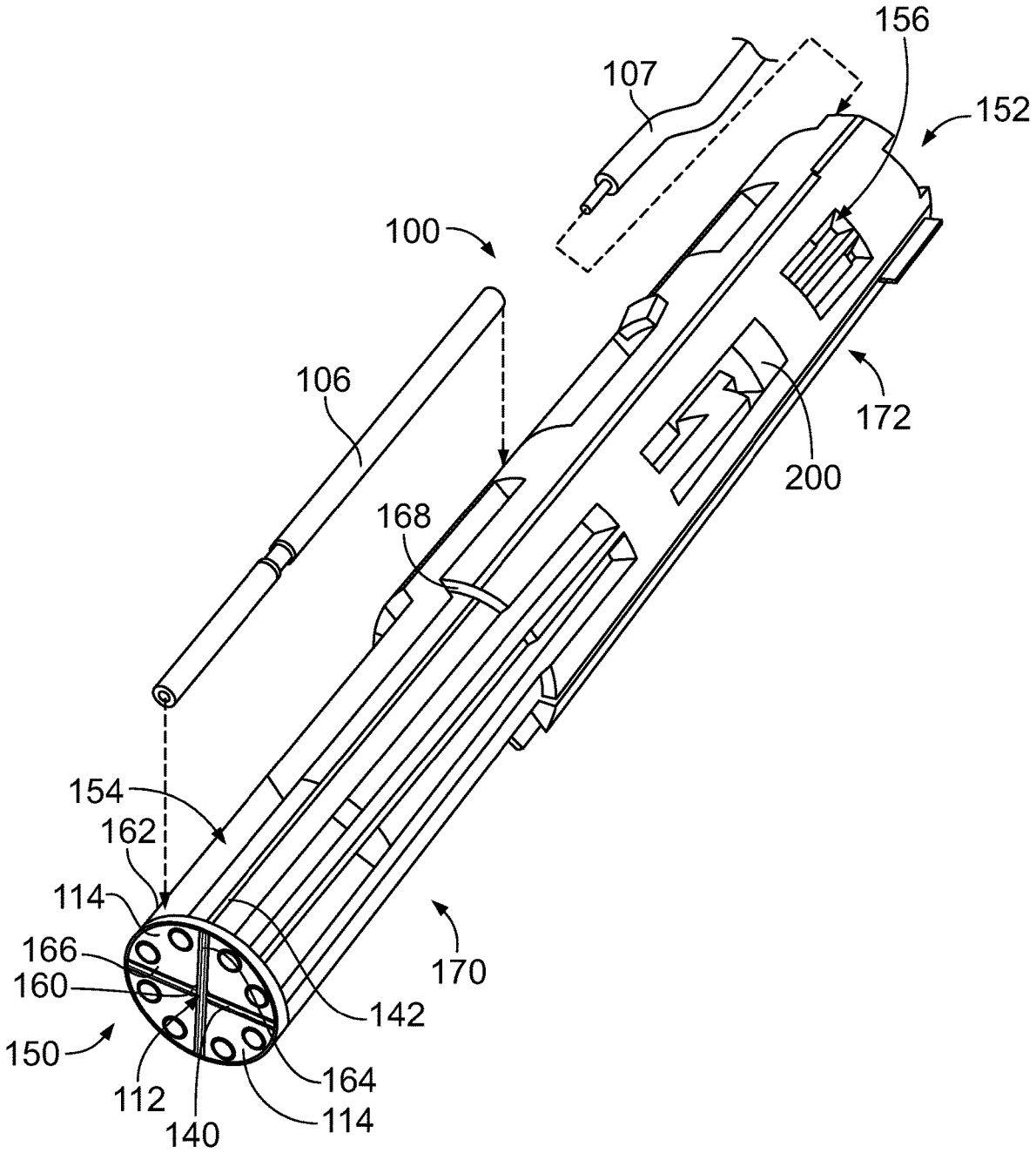
FIG. 5 is a front perspective view of a portion of the cable connector in accordance with an exemplary embodiment.
Figure 6:
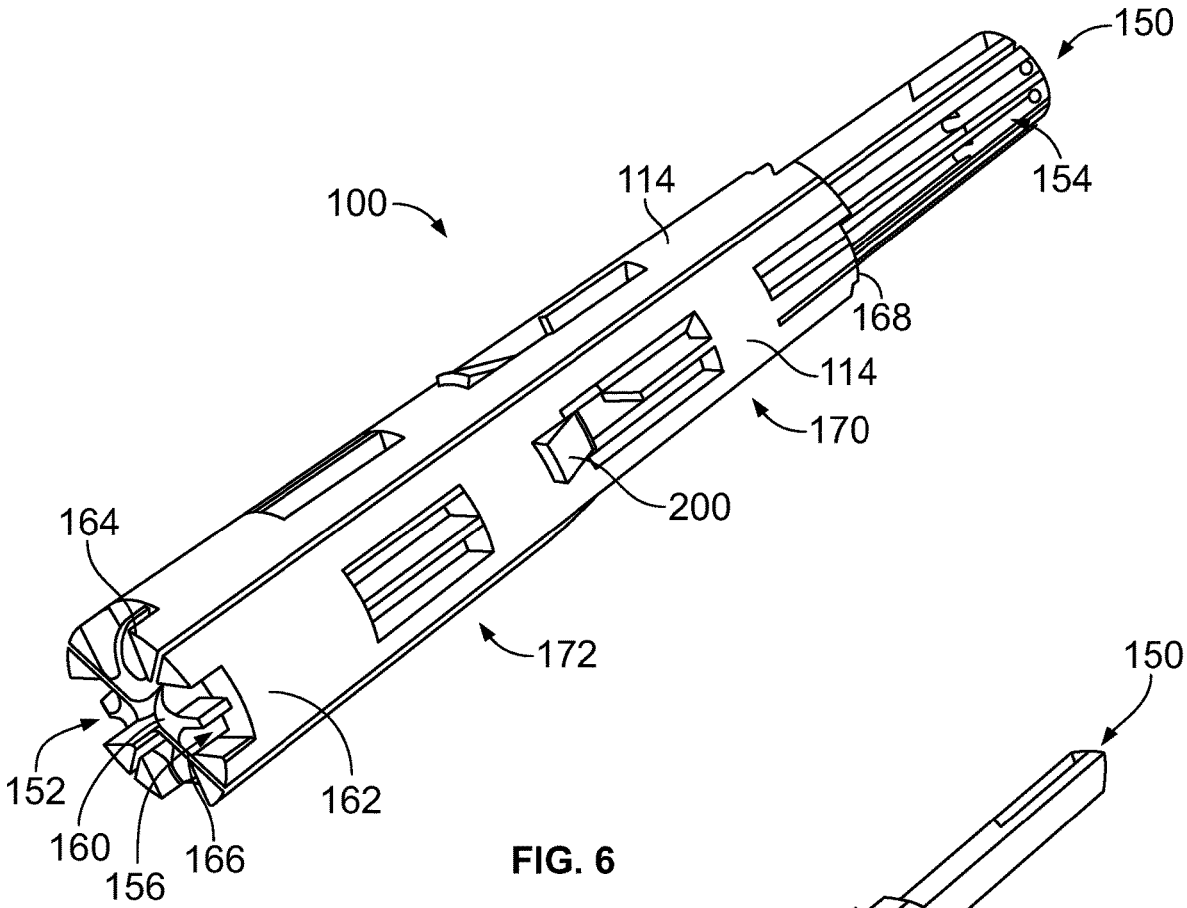
FIG. 6 is a rear perspective view of a portion of the cable connector in accordance with an exemplary embodiment.

FIG. 5 is a front perspective view of a portion of the cable connector 100 in accordance with an exemplary embodiment. FIG. 6 is a rear perspective view of a portion of the cable connector 100 in accordance with an exemplary embodiment. FIGS. 5 and 6 illustrate the cable connector 100 with the outer shell one (shown in FIG. 3) removed to illustrate the contact holders 114. FIG. 5 illustrates the cable connector 100 with the shield 112 between the cable holders 114. FIG. 6 illustrates the cable connector 100 without the shield 112.

In an exemplary embodiment, the cable connector 100 is provided with four cable holders 114 arranged in four quadrants defined by the shield 112. The cable connector 100 may include greater or fewer cable holders 114 in alternative embodiments. FIG. 5 illustrates the cable holders 114 at the mating end 150. FIG. 6 illustrates the cable holders 114 at the cable end 152. In an exemplary embodiment, each cable holder 114 is identical but at different orientations within the bundle.

The contact holder 114 includes one or more contact channels 154 at the mating end 150 and one or more wire channels 156 at the cable end 152. The contact channels 154 receive corresponding contacts 106 (one shown in FIG. 5 for illustration). The wire channels 156 received corresponding wires 107 (one shown in FIG. 5 for illustration). In the illustrated embodiment, each contact holder 114 includes a pair of the contact channels 154 and a pair of the wire channels 156. The contact holder 114 may include greater or fewer channels in alternative embodiments. In an exemplary embodiment, the wire channels 156 are open at the cable end 152 two feed the wires 107 into the wire channels 156. In an exemplary embodiment, the contact channels 154 are open at the sides of the contact holder 114 to allow the contacts 106 to be side loaded into the contact channels 154. Alternatively, the contact channels 154 may be closed in the contacts 106 may be loaded from the rear or from the front. In the illustrated embodiment, the contacts 106 are configured to be contained within the contact holder 114. Alternatively, the contacts 106 may extend from the front of the contact holder 114 for mating with the mating connector 50 (shown in FIG. 1).

In an exemplary embodiment, the contact holder 114 is pie-piece shaped being narrower at the radially inner end and wider at the radially outer end. The contact holder 114 includes an inner edge 160 and an outer end 162 opposite the inner edge 160. The contact holder 114 includes a first side 164 extending between the inner edge 160 and the outer end 162 and a second side 166 extending between the inner edge 160 and the outer end 162. The first and second sides 164, 166 face the shield panels 140, 142. Optionally, the first and second sides 164, 166 may be generally perpendicular to each other. In an exemplary embodiment, the outer end 162 has a curved outer surface with a radius of curvature similar to the radius of curvature of the outer shell one. In an exemplary embodiment, the inner edge 160 may be curved between the first and second sides 164, 166. The contact holder 114 may have other shapes in alternative embodiments.

In an exemplary embodiment, the contact holder 114 includes a shoulder 168 along the outer end 162. The shoulder 168 is configured to interface with the shoulder 138 (shown in FIG. 3) to position the contact holder 114 in the outer shell 110. The contact holder 114 may be smaller forward of the shoulder 168 and larger rearward of the shoulder 168. For example, the contact holder 114 may have a first width between the inner edge 160 and the outer end 162 at a forward portion 170 of the contact holder 114 and a second width between the inner edge 160 and the outer end 162 at a rearward portion 172 of the contact holder 114. The second width may be wider than the first width.

The contact holder 114 includes the latch 200. In the illustrated embodiment, the latch 200 is located proximate to the cable end 152. The latch 200 is formed integral with the contact holder 114. For example, the latch 200 and the body of the contact holder 114 are molded as a single, unitary, monolithic structure. The latch 200 is deflectable. The latch 200 includes a latching surface exposed at the outer end 162 configured to be latchably coupled to the outer shell 110 to secure the contact holder 114 in the outer shell 110.

Figure 7:
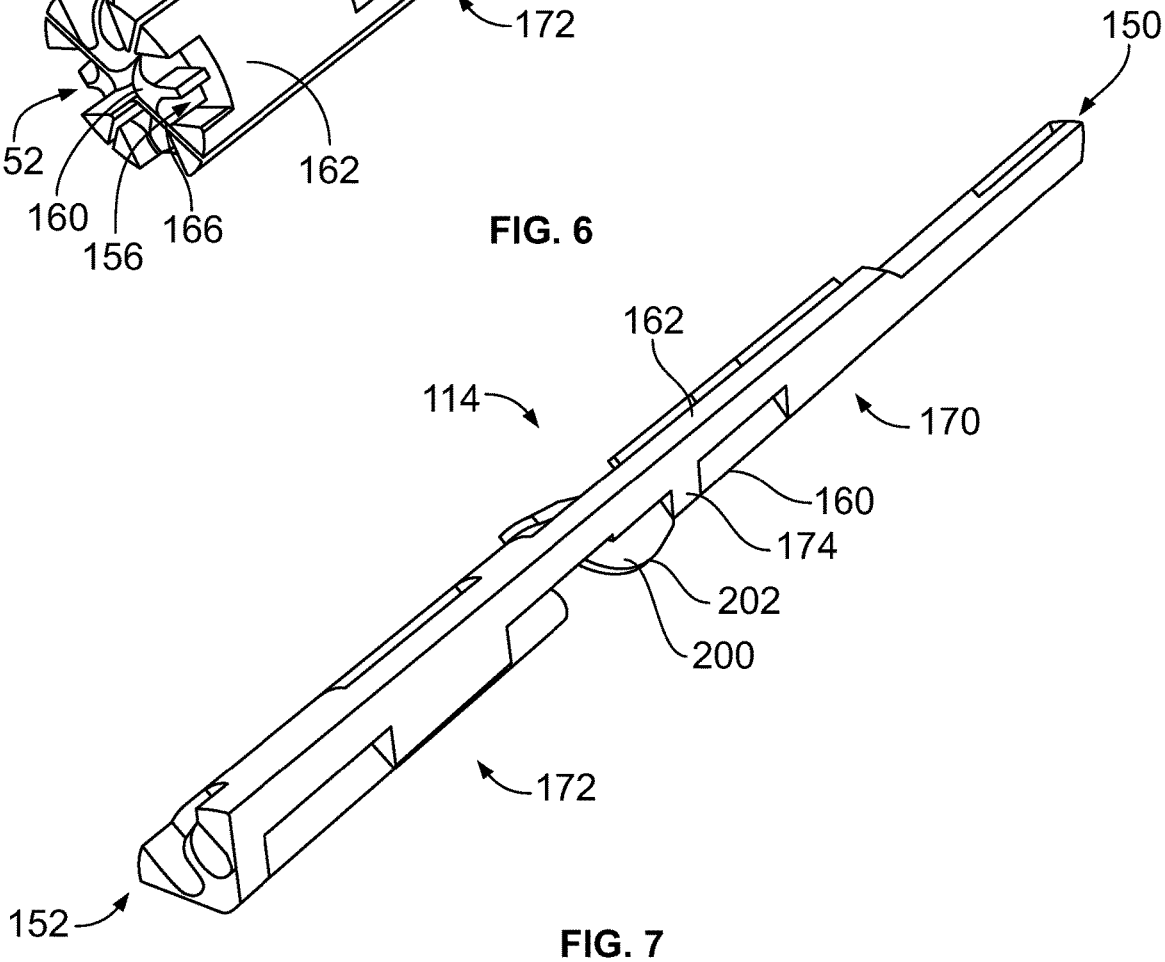
FIG. 7 is a rear perspective view of one of the contact holders in accordance with an exemplary embodiment.

FIG. 7 is a rear perspective view of one of the contact holders 114 in accordance with an exemplary embodiment. The contact holder 114 extends between the mating end 150 and the cable end 152. FIG. 7 illustrates the latch 200 extending from a base 174 of the contact holder 114. The base 174 is located between the forward portion 170 and the rearward portion 172.

In an exemplary embodiment, the latch 200 extends inward from the inner edge 160 to interface with the shield 112 (shown in FIG. 3) and extends outward beyond the outer end 162 two interface with the outer shell one (shown in FIG. 3). In an exemplary embodiment, as described in further detail below, the latch 200 is deflected outward during assembly by pressing against the inner portion of the latch 200 to force the outer portion of the latch 200 outward into the latch pocket 134 (shown in FIG. 3). For example, the latch 200 includes an interference bump 202 at the inner portion configured to engage the shield 112 to press the latch 200 outward. The interference bump 202 stand proud of the inner edge 160 to interfere with the shield 112 as the contact holder 114 is loaded into the outer shell 110. The outer latching edge of the latch 200 may stand proud of the outer end 162 to engage the outer shell 110. However, in various embodiments, the outer latching edge may be flush with or recessed relative to the outer end 162 until the interference bump 202 presses the latch 200 outward.

Figure 8:
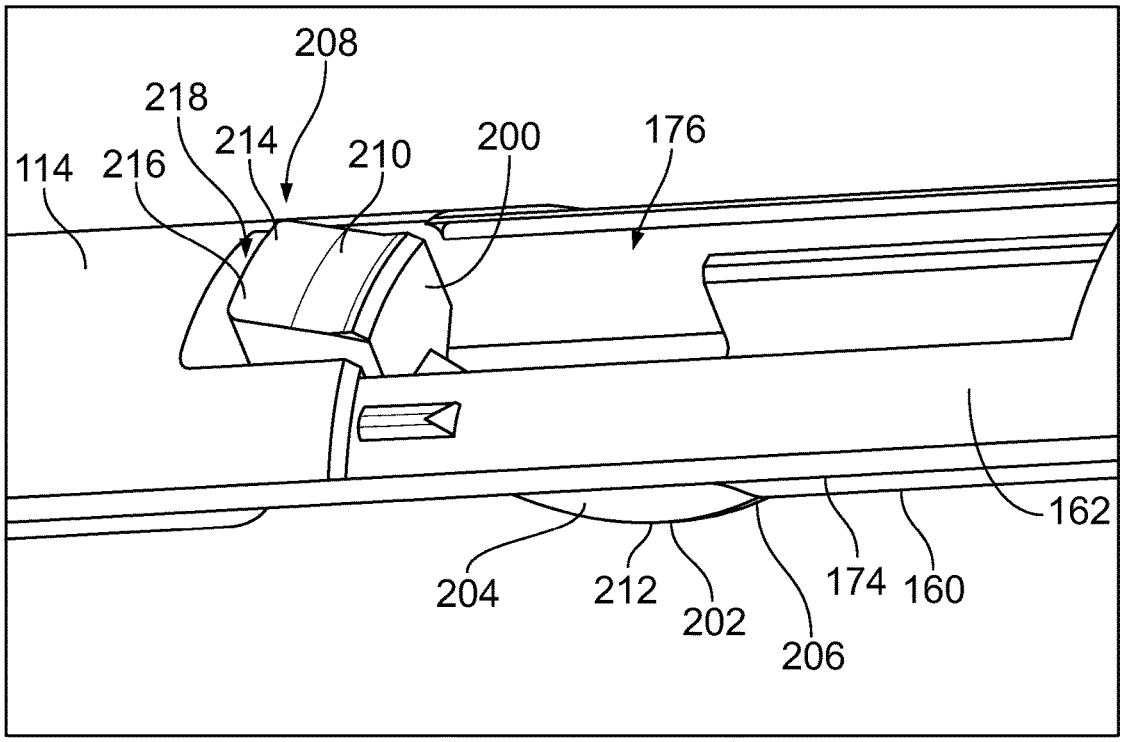
FIG. 8 is an outer perspective view of a portion of the contact holder in accordance with an exemplary embodiment.
Figure 9:
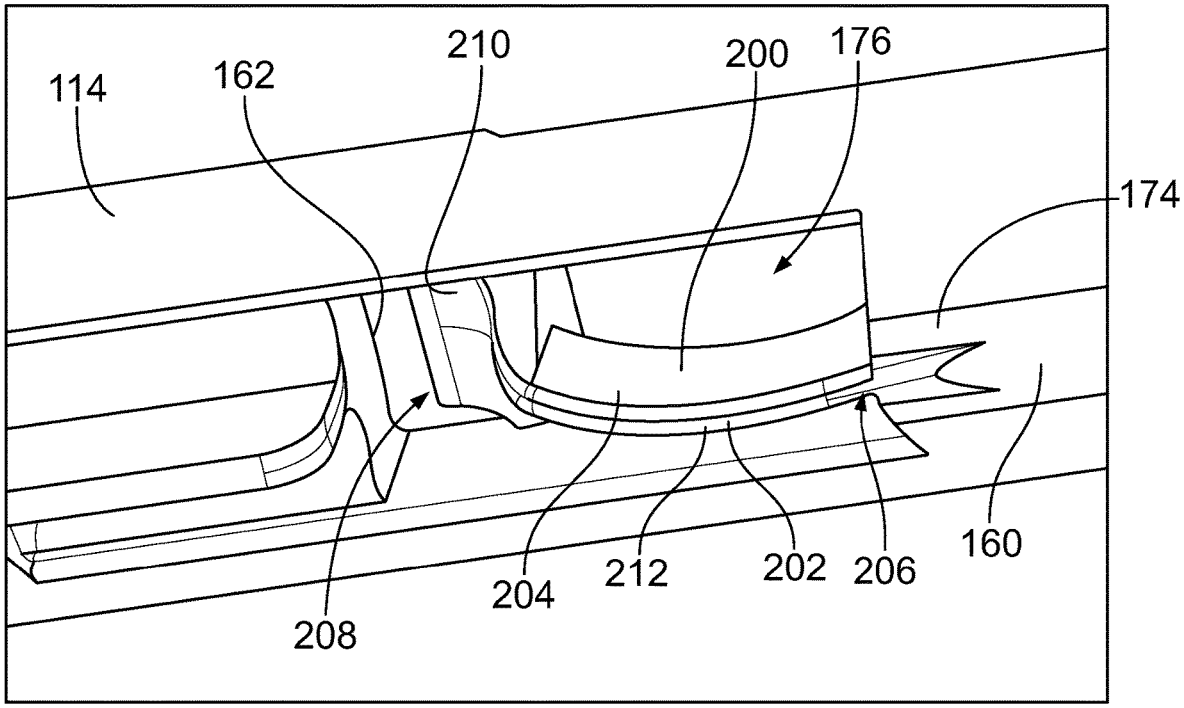
FIG. 9 is an inner perspective view of a portion of the contact holder in accordance with an exemplary embodiment.

FIG. 8 is an outer perspective view of a portion of the contact holder 114 in accordance with an exemplary embodiment. FIG. 9 is an inner perspective view of a portion of the contact holder 114 in accordance with an exemplary embodiment. FIGS. 8 and 9 illustrate the latch 200 extending from the base 174. In an exemplary embodiment, the contact holder 114 includes an opening 176 in the base 174. The latch 200 extends into the opening 176.

The latch 200 includes a latching arm 204 extending from a fixed end 206 to a distal end 208. The fixed end 206 is connected to the base 174. The latching arm 204 is cantilevered from the base 174. The latch 200 is deflectable and configured to be rotated or pivoted at the fixed end 206. The latch 200 includes a latching head 210 at the distal end 208. The latching head 210 is configured be received in the corresponding latch pocket 134 (shown in FIG. 3) of the outer shell 110 (shown in FIG. 3).

The latch 200 includes an inner surface 212 and an outer surface 214. The inner surface 212 is provided at the radially inner portion of the latch 200. The outer surface 214 is provided at a radially outer portion of the latch 200. In an exemplary embodiment, the latching head 210 is provided at the inner surface 212 and the interference bump 202 is provided at the outer surface 214. The interference bump 202, being at the inner surface 212, is configured to engage the shield 112 (shown in FIG. 3) when assembled. The latching head 210, being at the outer surface 214, is configured to engage the outer shell 110. For example, the latching head 210 is configured to be received in the latch pocket 134. In an exemplary embodiment, the latching head 210 includes an outer surface 216 that defines the outer surface 214. In various embodiments, the outer surface 216 may be provided at a latching edge 218 of the latching head 210. The latching edge 218 is the portion of the latching head 210 configured to engage the outer shell 110 and retain the latch 200 in the latch pocket 134. In alternative embodiments, the outer surface 216 may be provided at another location along the latching head 210, such as along a sliding bump (not shown) extending from the radially outer surface of the latching head 210 used to slide along the outer shell 110 during assembly to keep the latching edge 218 from engaging and sliding along the outer shell 110 during assembly. The sliding bump may have a flat surface or a curved surface to reduce interference and drag during assembly.

In an exemplary embodiment, the latch 200 is deflectable from a resting position to an extended position. The latch 200 moves outward from the resting position to the extended position. For example, when the interference bump 202 engages the shield 112, the latch 200 is pressed outward. During movement to the extended position, the latching arm 204 is pivoted to rotate the latching head 210 outward, such as into the latch pocket 134. In an exemplary embodiment, in the resting position, the latching head 210 is generally coincident with the outer end 162 at the outer surface of the contact holder 114. As such, the latching head 210 minimally, if at all, engages and slides along the outer shell 110 during assembly to reduce damage to the latching edge 218 of the latching head 210. In various embodiments, the latching head 210 may be slightly recessed from the outer end 162 of the contact holder 114. In the extended position, the latching head 210 stands proud of the outer end 162 of the contact holder 114 for receipt in the latch pocket 134. In an exemplary embodiment, in the resting position, the interference bump 202 stand proud of the inner edge 160 of the contact holder 114 to ensure that the interference bump 202 interference with and engages the shield 112 during assembly. The interference bump 202 is forced inward to the extended position by the shield 112 during assembly, which in turn forces the latching head 210 outward to the extended position.

Figure 10:
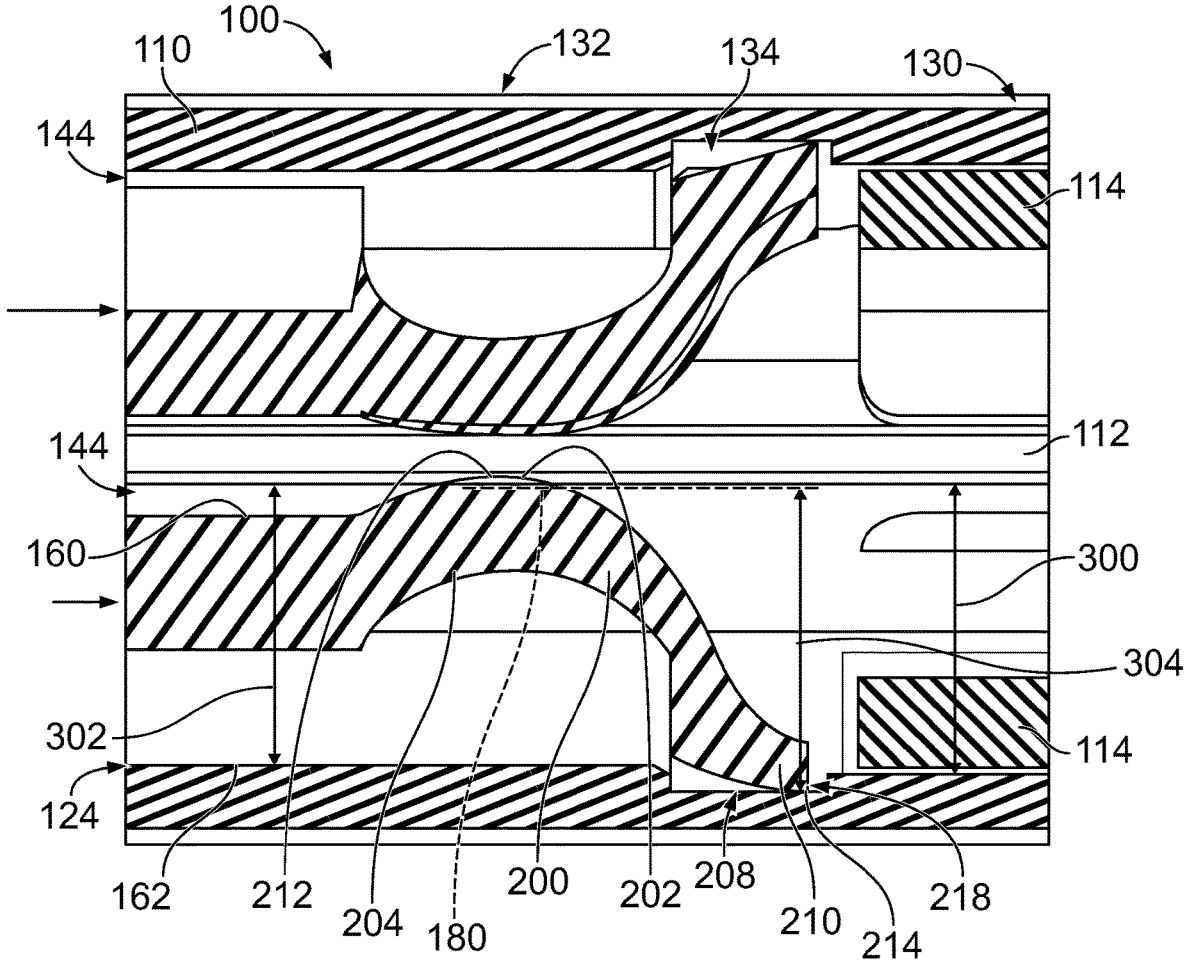
FIG. 10 is a cross-sectional view of a portion of the cable connector in accordance with an exemplary embodiment.

FIG. 10 is a cross-sectional view of a portion of the cable connector 100 in accordance with an exemplary embodiment. FIG. 10 illustrates the latches 200 of the contact holders 114 in latching positions. The latches 200 are shown deflected to the extended positions, in which the latching heads 210 of the latches 200 are received in the latch pockets 134. The shield 112 is shown between the contact holders 114. The shield 112 provides electrical shielding between the contact holders 114.

When assembled, the inner end 160 of the contact holder 114 faces the shield 112. The interference bump 202 stands proud of the inner end 160 to ensure engagement of the interference bump 202 with the shield 112. The interference bump 202 at the inner surface 212 of the latch 200 engages the shield 112 to press the latching head 210 outward into the latch pocket 134. The interference bump 202 is generally coincident with the inner end 160 in the extended position. Optionally, the interference bump 202 may be slightly extended from the inner end 160 to ensure that the interference bump 202 maintains engagement with the outer shell 110 to hold the latch 200 in the latching position.

The latch 200 is deflectable to the extended position by the engagement between the interference bump 202 and the shield 112 to press the latching head 210 into the latch pocket 134. The latching head 210 stands proud of the outer surface of the contact holder 114 in the extended position. The latching head 210 at the distal end 208 of the latch arm 204 is received in the latch pocket 134 to axially secure the contact holder 114 in the outer shell 110.

The outer shell 110 includes the forward portion 130 and the rearward portion 132 rearward of the forward portion 130. The forward portion 130 is forward of the latch pockets 134 and the rearward portion 132 is rearward of the latch pockets 134. In an exemplary embodiment, the contact holders 114 are rear loaded in a loading direction into the bore 124, and thus pass from the rearward portion 132 to the forward portion 130. The chambers 144 are defined by the shield 112 and the outer shell 110. The chambers 144 have a first width 300 at the forward portion 130 and a second width 302 at the rearward portion 132. The first width 300 is defined between the surface of the shield 112 and the inner surface of the outer shell 110 along the forward portion 130. The second width 302 is defined between the surface of the shield 112 and the inner surface of the outer shell 110 along the rearward portion 132. The second width 302 is wider than the first width 300. In an exemplary embodiment, the outer shell 110 is cylindrical. The forward portion 130 has a first diameter and the rearward portion 132 has a second diameter greater than the first diameter, leading to the different widths along the forward and rearward portions 130, 132.

The contact holder 114 is positioned in the chamber 144 in both the forward portion 130 and the rearward portion 132. The contact holder 114 has more clearance in the rearward portion 132 than the forward portion 130 due to the extra width along the rearward portion 132. During assembly, the contact holder 114 is loaded into the chamber 144 such that the latch 200 engages the shield 112. For example, the interference bump 202 slides along the surface of the shield 112. As the contact holder 114 slides into the forward portion 130, the body of the contact holder 114 is forced radially inward toward the shield 112. Such radial inward movement presses the interference bump 202 into the shield 112, which presses the latch 200 outward to the extended position. The radial inward movement of the body of the contact holder 114 forces the latching head 210 to press outward. The latching head 210 is pressed further outward when the interference bump 202 is in the forward portion 130 compared to the rearward portion 132. Along the rearward portion 132, the body of the contact holder 114 is able to sit in the chamber 144 further outward, spaced from the shield 112. Along the forward portion 130, the body of the contact holder 114 is positioned inward, closer to the shield 112, which forces the latch 200 outward. In an exemplary embodiment, the outer end 162 engages the outer shell 110 to locate the inner edge 160 relative to the shield 112. The inner edge 160 is positioned closer to the shield 112 along the forward portion 130 compared to the rearward portion 132. For example, because the outer shell 110 has a reduced diameter at the forward portion 130, the contact holder 114 is forced inward driving the inner edge 160 closed to the shield 112, which drives the interference bump 202 into the shield 112 and thus drives the latching head 210 outward into the latch pocket 134.

In an exemplary embodiment, the latch 200 has a latch width 304 between the inner surface 212 and the outer surface 214. The latch width 304 is defined between the inner surface 212 and the outer surface 214. For example, the latch width 304 is defined between the interference bump 202 and the latching head 210. In an exemplary embodiment, the latch width 304 is greater than the first width 300 through the forward portion 130. When the latch 200 is pushed outward to the extended position, the latching head 210 is pushed into the latch pocket 134. In an exemplary embodiment, the latch width 304 is less than or equal to the second width 302 through the rearward portion 132. As such, the latch 200 is able to slide through the chamber 144 in the rearward portion 132 with little or no sliding friction or damage to the latch 200, particularly to the latching edge 218. For example, the latch 200 may be able to pass through the rearward portion 132 without the latching edge 218 marring or deforming.

In various embodiments, the shield 112 may include a bump 180 (shown in phantom in FIG. 10) at the forward portion 130 to reduce the first width 300 compared to the second width 302. The bump 180 is positioned to interface with the interference bump 202 when the contact holder 114 is fully loaded into the chamber 144 to provide actuation of the latch 200 and force the latch 200 into the extended position. In various embodiment, the bump 180 may be used to actuate the latch 200 in lieu of the different diameter sections. In other words, the outer shell 110 may have a common diameter along the forward and rearward portions 130, 132 and the bump 180 pushes the interference bump 202 outward.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A cable connector comprising:

an outer shell having a bore, the outer shell extending between a mating end and a cable end, the outer shell having latch pockets;

a shield received in the outer shell, the shield dividing the bore into chambers, the shield and the outer shell providing shielding for the chambers;

contact holders received in corresponding chambers, each contact holder including at least one contact channel, each contact holder including a deflectable latch, the latch having a latching head at an distal end of the latch configured to be received in the corresponding latch pocket of the outer shell to axially secure the contact holder in the outer shell, the latch having an interference bump at an inner end of the latch configured to engage the shield to press the latching head of the latch outward; and contacts received in corresponding contact channels of the corresponding contact holders, the contacts held in the bore of the outer shell by the contact holders, each contact extending between a mating end and a terminating end, the terminating end configured to be terminated to a wire of a cable.

2. The cable connector of claim 1, wherein the latch is deflectable from a resting position to an extended position, the latching head being generally coincident with an outer surface of the contact holder in the resting position, the latching head standing proud of the outer surface in the extended position.

3. The cable connector of claim 1, wherein the contact holder includes an inner end facing the shield, the interference bump standing proud of the inner end.

4. The cable connector of claim 1, wherein the contact holder includes an inner end facing the shield, the latch being deflectable from a resting position to an extended position, the interference bump standing proud of the inner end in the resting position, the interference bump being pressed inward by the shield to the extended position.

5. The cable connector of claim 4, wherein the interference bump is generally coincident with the inner end in the extended position.

6. The cable connector of claim 1, wherein the outer shell includes a forward portion and a rearward portion rearward of the forward portion, the chambers having a first width at the forward portion and a second width at the rearward portion, the second width being wider than the first width, the latching head being pressed further outward in the forward portion compared to the rearward portion.

7. The cable connector of claim 6, wherein the forward portion has a first diameter and the rearward portion has a second diameter greater than the first diameter.

8. The cable connector of claim 6, wherein the forward portion is forward of the latch pockets and the rearward portion is rearward of the latch pockets.

9. The cable connector of claim 6, wherein the shield includes a bump at the forward portion to reduce the first width compared to the second width.

10. The cable connector of claim 6, wherein the contact holder includes an inner edge and an outer end opposite the inner edge, the outer end engaging the outer shell to locate the inner edge relative to the shield, the inner edge positioned closer to the shield along the forward portion compared to the rearward portion.

11. The cable connector of claim 6, wherein the latch includes an inner surface and an outer surface, the interference bump defining the inner surface, the latching head defining the outer surface, the latch having a latch width between the inner surface and the outer surface, the latch width being greater than the first width.

12. The cable connector of claim 11, wherein the latch width is less than or equal to the second width.

13. A cable connector comprising:

an outer shell having a bore, the outer shell extending between a mating end at a front of the outer shell and a cable end at a rear of the outer shell, the outer shell having a forward portion and a rearward portion rearward of the forward portion, the outer shell having latch pockets;

a shield received in the outer shell, the shield dividing the bore into chambers, the chambers having a first width at the forward portion and a second width at the rearward portion, the second width being wider than the first width, the shield and the outer shell providing shielding for the chambers;

contact holders received in corresponding chambers, each contact holder including at least one contact channel, each contact holder including a deflectable latch, the latch having a latching head at an distal end of the latch configured to be received in the corresponding latch pocket of the outer shell to axially secure the contact holder in the outer shell, the latch having an interference bump at an inner end of the latch, the inner end engaging the shield to press the latching head of the latch outward, wherein the latching head is pressed further outward in the forward portion compared to the rearward portion; and contacts received in corresponding contact channels of the corresponding contact holders, the contacts held in the bore of the outer shell by the contact holders, each contact extending between a mating end and a terminating end, the terminating end configured to be terminated to a wire of a cable.

14. The cable connector of claim 13, wherein the forward portion has a first diameter and the rearward portion has a second diameter greater than the first diameter.

15. The cable connector of claim 13, wherein the forward portion is forward of the latch pockets and the rearward portion is rearward of the latch pockets.

16. The cable connector of claim 13, wherein the shield includes a bump at the forward portion to reduce the first width compared to the second width.

17. The cable connector of claim 13, wherein the contact holder includes an inner edge and an outer end opposite the inner edge, the outer end engaging the outer shell to locate the inner edge relative to the shield, the inner edge positioned closer to the shield along the forward portion compared to the rearward portion.

18. The cable connector of claim 13, wherein the latch includes an inner surface and an outer surface, the interference bump defining the inner surface, the latching head defining the outer surface, the latch having a latch width between the inner surface and the outer surface, the latch width being greater than the first width.

19. The cable connector of claim 18, wherein the latch width is less than or equal to the second width.

20. A cable connector comprising:

an outer shell having a bore, the outer shell being generally cylindrical, the outer shell extending between a mating end and a cable end, the outer shell having latch pockets;

a shield received in the outer shell, the shield having a first shield panel and a second shield panel perpendicular to the first shield panel dividing the bore into four chambers, the shield and the outer shell providing shielding for the chambers;

contact holders received in corresponding chambers, each contact holder including a first side wall and a second side wall meeting at an inner edge, each contact holder including an outer wall between the first side wall and the second side wall, each contact holder including a pair of contact channels, each contact holder including a deflectable latch, the latch including a latch arm extending between a fixed end and a free end, the latch arm extending along the inner edge, the latch having a latching head at the free end of the latch configured to be received in the corresponding latch pocket of the outer shell to axially secure the contact holder in the outer shell, the latch having an interference bump at an inner end of the latch configured to engage the shield to press the latching head of the latch outward; and contacts received in corresponding contact channels of the corresponding contact holders, the contacts arranged in pairs, the contacts held in the bore of the outer shell by the contact holders, each contact extending between a mating end and a terminating end, the terminating end configured to be terminated to a wire of a cable.

* * * * *